United States Patent [19]

Katzman et al.

[11] Patent Number: 4,626,225

[45] Date of Patent: Dec. 2, 1986

[54] TOY FIGURES WITH FLEXIBLE HAIR INSERTS

[75] Inventors: Allison W. Katzman, Chicago; Donald A. Rosenwinkel, Oak Park; Harry Disko, South Barrington, all of Ill.

[73] Assignee: Marvin Glass & Associates, Chicago, Ill.

[21] Appl. No.: 699,833

[22] Filed: Feb. 8, 1985

[51] Int. Cl.[4] ..... A63H 3/00; A63H 3/44

[52] U.S. Cl. ..... 446/394; 446/372

[58] Field of Search ..... 446/319, 372, 394, 385, 446/313, 97, 99, 100

[56] References Cited

U.S. PATENT DOCUMENTS

| | | | |
|---|---|---|---|
| 946,013 | 1/1910 | Clarke | 446/372 |
| 1,810,566 | 6/1931 | Keney | 446/394 |
| 3,054,711 | 9/1962 | Powell | 446/385 X |
| 3,670,451 | 6/1972 | Groves et al. | 446/319 |
| 3,694,957 | 10/1972 | Houghton | 446/319 |
| 3,765,123 | 10/1973 | Terzian | 446/394 |
| 4,563,390 | 1/1986 | Bedell et al. | 446/394 X |

FOREIGN PATENT DOCUMENTS

| | | | |
|---|---|---|---|
| 0104124 | 3/1984 | European Pat. Off. | 446/319 |
| 2411618 | 7/1979 | France | 446/394 |
| 2533452 | 3/1984 | France | 446/97 |
| 2537880 | 6/1984 | France | 446/319 |
| 1363496 | 8/1974 | United Kingdom | 446/319 |

*Primary Examiner*—Robert E. Bagwill
*Assistant Examiner*—D. Neal Muir
*Attorney, Agent, or Firm*—John S. Pacocha

[57] ABSTRACT

A toy horse figure with a generally hollow body of plastic is provided with a soft flexible mane and tail. The flexible strands of the mane are secured to a foldable membrane, adjacent to, but inward of, a relief decorated edge along each foldable side. When compressed and inserted into an elongated slot formed by recesses in mating shells of the body the decorated relief obscures both the opening and the attachment of the flexible strand. Posts used to secure mating shell halves of the body pass through apertures in the foldable membrane to secure it against removal. For the tail, flexible strands are inserted into an opening in a compressible grommet which in turn is inserted into an opening formed in the body with a decorated relief on the outer flange obscuring the opening and the attachment of the tail strands.

15 Claims, 7 Drawing Figures

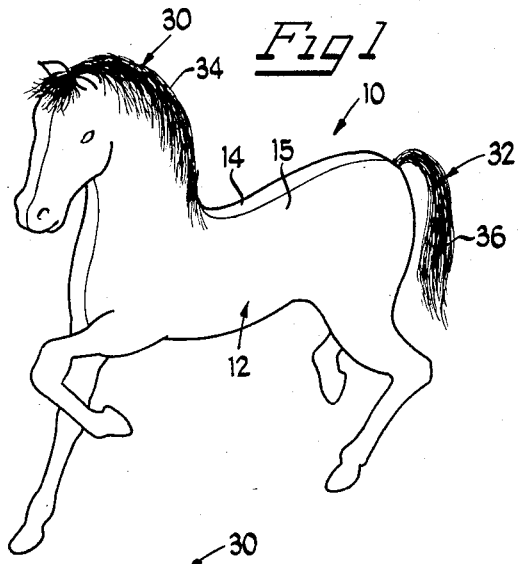
Fig 1
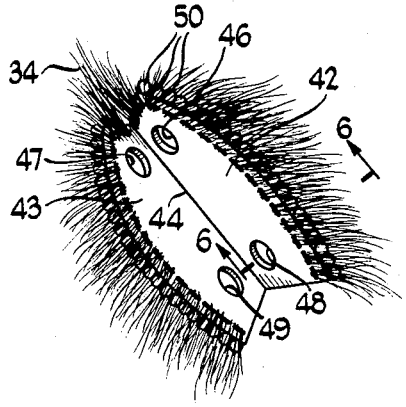
Fig 5
Fig 7
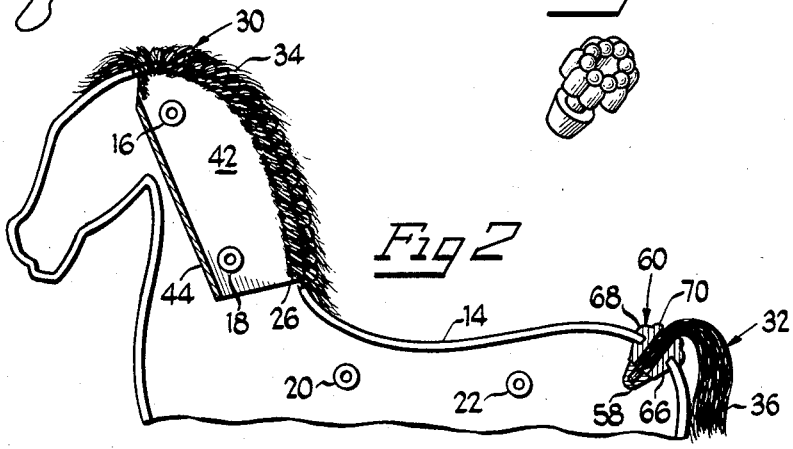
Fig 2
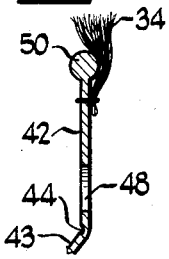
Fig 6
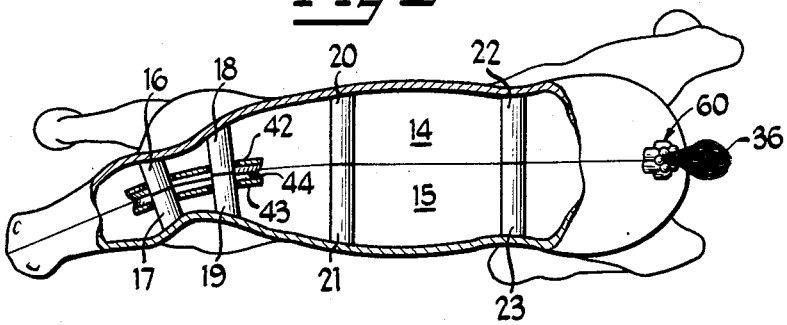
Fig 3
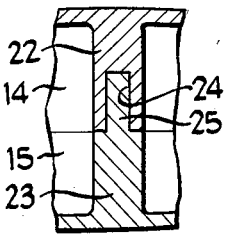
Fig 4

TOY FIGURES WITH FLEXIBLE HAIR INSERTS

BACKGROUND OF THE INVENTION

1. Field of the Invention

This invention relates to toy animals and more particularly to toy plastic animals having flexible strands of simulated hair.

2. Background Art

Toy figures, both human and animal, have been provided with strands of material simulating hair by "rooting", a form of stitching, as well as by attaching such strands with adhesives. While the "rooting" method provide an aesthetically pleasing finished product, it is a relatively time consuming and expensive process. The use of adhesives, on the other hand, leaves something to be desired from an aesthetical standpoint. Accordingly, there remains a need for a facile, economical, aesthetically pleasing method of securing flexible strands of simulated hair to a toy plastic figure particularly a relatively small scale animal figure.

SUMMARY OF THE INVENTION

The present invention is concerned with providing toy hollow animal figures such as horses with flexible strands of simulated hair in areas such as the mane and tail. These and other objects and advantages of the invention are achieved by providing an intermediate member to which the flexible strands are attached and then inserting the intermediate member into openings provided in the respective areas of the plastic animal. The intermediate member is provided with a decorative edge relief which obscures both the attachment of the strands and the opening once the member is inserted. Accordingly, the method of attachment of the strands to the intermediate member is of no aesthetic consequence since it is hidden within the hollow plastic figure.

BRIEF DESCRIPTION OF THE DRAWING

For a better understanding of the present invention reference may be had to the accompanying drawing in which:

FIG. 1 is a perspective view of an embodiment of the present invention;

FIG. 2 is an enlarged scale, fragmentary, vertical sectional view;

FIG. 3 is a top plan view partially broken away;

FIG. 4 is an enlarged scale, fragmentary, representative sectional view of the internal connection of two molded halves;

FIG. 5 is an enlarged scale perspective view of an intermediate mane securing member;

FIG. 6 is an enlarged scale sectional view taken generally along the line 6—6 of FIG. 5; and FIG. 7 is an enlarged scale perspective view of the intermediate tail securing member.

DETAILED DESCRIPTION OF THE PREFERRED EMBODIMENT

Referring now to the drawing in which like parts are designated by like reference numerals throughout the several views, there is shown in FIG. 1 a toy horse figure 10 having a body 12 made of a hard plastic such as polystyrene or polyethylene or a relatively softer material such as vinyl. Body 12 is formed of two mating halves 14 and 15 which are secured together to form a hollow shell. Each half is connected to each other by a series of posts 16–17, 18–19, 20–21 and 22–23. For a differently shaped or styled toy figure, more or less of the connecting posts may be required. As is representatively illustrated in FIG. 4 each of the posts, such as 22, extending inwardly from half 14, are formed with a socket 24 while each post, such as 23, on the other half shell are formed with a projection peg 25 that fits within the socket 24. Shell halves 14 and 15 may be held together by a tight fit of the pegs in the sockets or an adhesive may be employed. Along the parting line each of the shell halves has a recess along the neck that forms an elongated rectangular slot 26 and a small semicircular recess adjacent the back end that forms a circular opening 28.

Horse 10 is provided with a mane 30 and a tail 32 of soft flexible strands 34 of synthetic hairlike material for the mane and similar strands 36 for the tail. Flexible strands 34 are secured adjacent, but inwardly of, the outside edge of a foldable resilient compressible membrane 40 preferably made of a soft material such as vinyl. Membrane 40 has two elongated sides 42 and 43 foldable toward each other. The facilitate folding along the center a crease or cut 44 is provided. Each side is provided with a pair of apertures 46 and 47, respectively, adjacent one end plus another pair of apertures 48 and 49, respectively, adjacent the other end. When the two sides are folded together, apertures 46–47 are aligned and apertures 48–49 are aligned. Along the outside elongated edge of each side of the membrane there is an integrally formed relief decoration, such as beading 50, that is significantly thicker than the rest of the side. Strands of the flexible material 34 are secured to the inside face of each of the sides 42 and 43 adjacent, but inward of, the beaded edge 50 by stitching or adhesives.

Membrane 40, with the attached flexible strands 34 is folded together and inserted into the elongated slot 26 formed by the recesses along the parting lines of each of the shell halves 14 and 15. The resiliency of the membrane will serve to retain it within the elongated slot. However, in the illustrated preferred embodiment, the folded membrane is initially laid along the recess for the elongated slot 26 in shell half 14 with post 16 extending through the aligned slots 46–47 and post 18 extending through the aligned slots 48–49. Mating shell half 15 is then added with the posts 17 and 19 being secured to posts 16 and 18 respectively thus more permanently securing membrane 40 against removal. Once the two sides of membrane 40 are folded together, the decorative or beaded edge 50 obscures both the attachment of the individual strands of flexible material 34 as well as the edges of the elongated slot 26. Any slight gaps at the bottom and top end of the slot 26 are further hidden by the depending strands of material 34 at the base of the mane and a forwardly combed forelock at the top of the mane.

For attachment of the tail 32, individual strands of material 36 are first be secured at one end by gluing or crimping the strands in a plug 58. A compressible grommet 60 then receives the plug through a generally centrally disposed aperture 62 in the grommet. The outside of grommet 60 has an annular groove 64 of a diameter larger than the diameter of the aperture 28 in the horse. Below the groove is a tapered flange 66 and above the groove is an enlarged flange 68. Surrounding the aperture 62 and around the outside edge of flange 68 is relief beading 70. Particularly after grommet 60 is compressed by insertion in the generally circular aperture 28 in the horse, the plug 58 is retained against removal. Decorative beading on the tail grommet 60 like decorative beading 50 on the mane membrane 40 serves to obscure both the opening in the body of the horse and the attachment of the individual strands of flexible material forming the tail.

While a particular embodiment of the present invention has been shown and described, changes and modifications will occur to those skilled in the art. It is intended in the appended claims to cover all such changes and modifications as fall within the true spirit and scope of the present invention.

What is claimed as new and desired to be secured by Letters Patent is:

1. A toy figure comprising:

a generally hollow body formed of mating shells of a relatively rigid material;

at least one of the mating shells having an inwardly extending post;

an opening extending through the body;

flexible strands of material secured to a compressible member;

decorations formed in relief adjacent the outside edge of the member obscuring the attachment of the flexible strands;

the member being insertable into the opening in the body with the decorative edge obscuring the opening;

the member having an aperture; and the post fitting through the aperture to secure the member against removal.

2. The toy figure of claim 1 in which:

the mating shells are at least partially secured to each other by inwardly extending connecting posts; and one of the connecting posts fits through the aperture to secure the member against removal.

3. The toy figure of claim 1 in which the body is that of a horse and the flexible strands and member form the mane.

4. The toy figure of claim 1 in which:

the member is elongated and foldable along the elongated dimension; and the decorative relief is provided along each outside elongated edge.

5. The toy figure of claim 1 in which the body is that of a horse and the flexible strands and member form the tail.

6. The toy figure of claim 1 in which:

the member has two sides with each side having an outside edge and being foldable toward the other side; and the decorative relief is provided along each outside edge.

7. The toy figure of claim 1 in which:

the member has two sides foldable toward each other; and each side has an aperture that aligns with the other to form the aperture for the post to fit through.

8. A toy figure comprising:

a generally hollow body formed of a relatively rigid material;

a compressible member having a middle and two outside edges, the member being foldable generally along the middle to position the two outside edges adjacent each other;

flexible strands of material secured to the compressible member;

the member being partially inserted into and secured within the body opening with the outside edges plus a substantial portion of the flexible strands outside of the body; and decorations formed in relief adjacent the outside edges of the member obscuring the attachment of the flexible strands and the body opening.

9. The toy figure of claim 8 in which:

the member is elongated and folded along the elongated dimension; and the decorative relief being provided along each elongated edge that is outside the body.

10. The toy figure of claim 8 in which the generally hollow body is formed of mating shells.

11. The toy figure of claim 10 in which:

at least one of the mating shells has an inwardly extending post;

the compressible member has an aperture; and the post fits through the aperture to secure the member against removal.

12. The toy figure of claim 11 in which the member has two apertures that align when the member is folded to form the aperture for the post to fit through.

13. The toy figure of claim 11 in which the mating shells are at least partially secured to each other by inwardly extending connecting posts; and one of the connecting posts fits through the aperture to secure the member against removal.

14. The toy figure of claim 8 in which the body is that of a horse and the flexible strands and member form the mane.

15. The toy figure of claim 8 in which the body is that of a horse and the flexible strands and member form the tail.

* * * * *